US009917355B1

(12) United States Patent
Lee et al.

(10) Patent No.: US 9,917,355 B1
(45) Date of Patent: Mar. 13, 2018

(54) WIDE FIELD OF VIEW VOLUMETRIC SCAN AUTOMOTIVE RADAR WITH END-FIRE ANTENNA

(71) Applicant: Toyota Motor Engineering & Manufacturing North America, Inc., Erlanger, KY (US)

(72) Inventors: Jae Seung Lee, Ann Arbor, MI (US); Paul Schmalenberg, Ann Arbor, MI (US)

(73) Assignee: TOYOTA MOTOR ENGINEERING & MANUFACTURING NORTH AMERICA, INC., Erlanger, KY (US)

( * ) Notice: Subject to any disclaimer, the term of this patent is extended or adjusted under 35 U.S.C. 154(b) by 37 days.

(21) Appl. No.: 15/287,629

(22) Filed: Oct. 6, 2016

(51) Int. Cl.

| | |
|---|---|
| ***H01Q 1/32*** | (2006.01) |
| ***H01Q 1/22*** | (2006.01) |
| ***H01Q 1/38*** | (2006.01) |
| ***H01Q 3/08*** | (2006.01) |
| ***H01Q 3/00*** | (2006.01) |
| ***H01Q 1/42*** | (2006.01) |

(52) U.S. Cl.
CPC ..... *H01Q 1/3283* (2013.01); *H01Q 1/2208* (2013.01); *H01Q 1/38* (2013.01); *H01Q 1/42* (2013.01); *H01Q 3/005* (2013.01); *H01Q 3/08* (2013.01)

(58) Field of Classification Search
CPC ..... H01Q 1/3233; H01Q 1/3283; H01Q 1/38; H01Q 1/42; H01Q 3/005
See application file for complete search history.

(56) References Cited

U.S. PATENT DOCUMENTS

| | | | |
|---|---|---|---|
| 4,298,873 | A | 11/1981 | Roberts |
| 4,414,550 | A | 11/1983 | Tresselt |
| 5,023,623 | A | 6/1991 | Kreinheder et al. |
| 5,023,624 | A | 6/1991 | Heckaman et al. |

(Continued)

FOREIGN PATENT DOCUMENTS

| | | |
|---|---|---|
| CN | 104122556 | 10/2014 |
| DE | 102013100554 | 1/2013 |

(Continued)

OTHER PUBLICATIONS

Ye et al.; "A Dual-Band Printed End-Fire antenna with DSPSL Feeding" 6 pages; Dec. 17, 2015.
Amadjikpé "Integrated 60-GHz Antenna on Multilayer Organic Package with Broadside and End-Fire Radiation" *IEEE Transactions on Microwave Theory and Techniques*, vol. 61, No. 1, pp. 303-315; Jan. 2013.

(Continued)

*Primary Examiner* — Graham Smith
(74) *Attorney, Agent, or Firm* — Snell & Wilmer L.L.P.

(57) ABSTRACT

A vehicular radar system includes a plurality of end-fire antennas including a first array of antennas positioned along a first plane and having a transmission end oriented in a first direction, a second array of antennas positioned along the first plane and having a transmission end oriented in a second direction that is different than the first direction, a third array of antennas positioned along a second plane above or below the first plane and having a transmission end oriented in the first direction, and a fourth array of antennas positioned along the second plane and having a transmission end oriented in the second direction. The vehicular radar system also includes at least one RFIC to control the plurality of antennas to scan for objects in the first direction, the second direction, and between the first direction and the second direction by transmitting signals of varying phases to the antennas.

20 Claims, 11 Drawing Sheets

(56) References Cited

U.S. PATENT DOCUMENTS

| | | | |
|---|---|---|---|
| 5,227,808 | A | 7/1993 | Davis |
| 5,400,042 | A | 3/1995 | Tulintseff |
| 5,486,832 | A | 1/1996 | Hulderman |
| 5,557,291 | A | 9/1996 | Chu et al. |
| 5,767,793 | A | 6/1998 | Agravante et al. |
| 5,872,542 | A | 2/1999 | Simons et al. |
| 5,874,915 | A | 2/1999 | Lee et al. |
| 5,940,011 | A | 8/1999 | Agravante et al. |
| 6,046,703 | A | 4/2000 | Wang et al. |
| 6,061,035 | A | 5/2000 | Kinasewitz et al. |
| 6,154,176 | A | 11/2000 | Fathy et al. |
| 6,317,094 | B1 | 11/2001 | Wu et al. |
| 6,366,254 | B1 | 4/2002 | Sievenpiper et al. |
| 6,496,151 | B1 | 12/2002 | Ferreri et al. |
| 6,496,155 | B1 | 12/2002 | Sievenpiper et al. |
| 6,549,170 | B1 | 4/2003 | Kuo et al. |
| 6,624,845 | B2 | 9/2003 | Loyd et al. |
| 6,815,739 | B2 | 11/2004 | Huff et al. |
| 6,950,062 | B1 | 9/2005 | Mather et al. |
| 7,109,938 | B2 | 9/2006 | Franson et al. |
| 7,170,446 | B1 | 1/2007 | West et al. |
| 7,268,732 | B2 | 9/2007 | Gotzig et al. |
| 7,411,542 | B2 | 8/2008 | O'Boyle |
| 7,532,170 | B1 | 5/2009 | Lee et al. |
| 7,728,772 | B2 | 6/2010 | Mortazawi et al. |
| 7,742,004 | B2 | 6/2010 | Fukushima et al. |
| 7,821,355 | B2 | 10/2010 | Engel et al. |
| 7,924,226 | B2 | 4/2011 | Soler Castany et al. |
| 8,175,512 | B2 | 5/2012 | Cornwell |
| 8,259,032 | B1 | 9/2012 | Buckley |
| 8,319,678 | B2 | 11/2012 | Weiss |
| 8,405,468 | B2 | 3/2013 | Uchaykin |
| 8,576,111 | B2 | 11/2013 | Smith et al. |
| 8,604,991 | B2 | 12/2013 | Nagayama |
| 8,836,592 | B2 | 9/2014 | Paulus et al. |
| 8,902,117 | B2 | 12/2014 | Ohno et al. |
| 8,912,968 | B2 | 12/2014 | Sharma et al. |
| 8,922,448 | B2 | 12/2014 | Wong et al. |
| 8,952,678 | B2 | 2/2015 | Giboney et al. |
| 9,013,365 | B2 | 4/2015 | Lee et al. |
| 9,065,163 | B1 | 6/2015 | Wu et al. |
| 9,142,889 | B2 | 9/2015 | Pazin et al. |
| 9,214,739 | B2 | 12/2015 | Sover et al. |
| 9,225,058 | B2 | 12/2015 | DeVries et al. |
| 9,337,542 | B2 | 5/2016 | Coburn et al. |
| 9,397,740 | B2 | 7/2016 | Maltsev et al. |
| 2005/0225481 | A1 | 10/2005 | Bonthron |
| 2006/0044189 | A1 | 3/2006 | Livingston et al. |
| 2012/0194377 | A1 | 8/2012 | Yukumatsu et al. |
| 2012/0235881 | A1 | 9/2012 | Pan et al. |
| 2012/0295015 | A1 | 11/2012 | Yang |
| 2013/0076579 | A1 | 3/2013 | Zhang et al. |
| 2013/0201076 | A1 | 8/2013 | Vos et al. |
| 2014/0070994 | A1 | 3/2014 | Schmalenberg et al. |
| 2014/0266902 | A1 | 9/2014 | Kamgaing et al. |
| 2015/0070228 | A1 | 3/2015 | Gu et al. |
| 2015/0130673 | A1 | 5/2015 | Ng et al. |
| 2015/0268336 | A1 | 9/2015 | Yukumatsu et al. |
| 2016/0033638 | A1 | 2/2016 | Silc |
| 2016/0125713 | A1 | 5/2016 | Blech et al. |

FOREIGN PATENT DOCUMENTS

| | | |
|---|---|---|
| WO | WO 01/52352 | 7/2001 |
| WO | WO 2009092695 | 3/2009 |
| WO | WO 2012076994 | 6/2012 |
| WO | WO 2014184554 | 11/2014 |

OTHER PUBLICATIONS

Beer et al.; "Novel Antenna Concept for Compact Millimeter-Wave Automotive Radar Sensores;" *IEEE Antennas and Wireless Propagation Letters*; vol. 8; pp. 771-774; Jul. 7, 2009.

Bisognin et al.; "3D Printed Plastic 60 GHz Lens: Enabling Innovative Millimeter Wave antenna Solution and System;" *2014 IEEE MTT-S International Microwave Symposium* (IMS2014); 4 pages; Jun. 1, 2014.

Choukiker et al.; "Hybrid Fractal Shape Planar Monopole Antenna Covering Multiband Wireless Communication with MIMO Implementation for Handheld Mobile Devices;" *IEEE Transactions on Antennas and Propagation*; vol. 62; No. 3; pp. 1483-1488; Dec. 17, 2013.

Dhiman et al.; "Effect of DGS Technique in MIMO Antenna;" *International Journal of Current Engineering and Technology*; vol.; No. 5; pp. 3138-3141; Oct. 2015.

Djerafi et al.; "Innovative Multilayered Millimetre-Wave Antennas for Multi-Dimensional Scanning and Very Small Footprint Applications" Mar. 26, 2012.

Jansen et al.; "Antenne Design for 24 GHz and 60 GHz Emerging Microwave Applications," *Koninklijke Philips Electronics N.V. 2006*; 137 pages; Jul. 2006.

Li et al.; "A Compact Wideband MIMO Antenna with Two Novel Bent Slits;" *IEEE Transactions on Antennas and Propagation*; vol. 60; No. 2; pp. 482-489; Feb. 2012.

Li, Yuan; "Development of Micromachined Millimeter Wave Modules for Wireless Communication Systems;" Georgia Institute of Technology; 128 pages; Aug. 2010.

Litzenberger et al.; "Study of Waveguide Antenna Implemented in Laminated Material" Dec. 2002.

Ranade, et al.; "Design of a Substrate Integrated Waveguide H Plane Horn Antenna on a PTFE Substrate for Automotive Radar Applications;" *Applied Electromagnetics Conference* (*AEMC*), *2011 IEEE*; 4 pages; Dec. 18, 2011.

Schwering, Felix K.; "Millimeter Wave Antennas;" *Proceedings of the IEEE*; vol. 80; No. 1; pp. 92-102; Jan. 1992.

Shamsinejad et al.; "Microstrip-Fed 3-D Folded Slot Antenna on Cubic Structure;" *IEEE Antennas and Wireless Propagation Letters*; vol. 15; pp. 1081-1084; 2016.

Tahim et al.; "Multi-Band Antenna Technology;" *Antennas and Propagation Society International Symposium, 2004. IEEE*; vol. 4; pp. 3968-3971; Jun. 20, 2004.

Yang; "Dual Band-Notched Ultrawideband MIMO Antenna Array;" *Wireless Symposium* (*IWS*), *2013 IEEE International*; 4 pages; Apr. 18, 2013.

Yuan et al. "Multiband Printed and Double-Sided Dipole Antenna for Wian/WiMax Applications" Microwave and Optical Technology Letters, vol. 42, No. 4, pp. 1019-1022, Apr. 2012.

Harvey et al. "Spatial Power Combining for High-Power Transmitters" *IEEE Microwave*; pp. 48-59; Dec. 2000.

Larumbe-Gonzalo et al. "Coherently Fed Frequency Scanning Phased Array Structure for Imaging Applications" IEEE 6$^{th}$ European Conference on Antennas and Propagation (EUCAP); pp. 2802-2806; 2011.

Li et al. "Dual-Beam Steering Microstrip Leaky Wave Antenna with Fixed Operating Frequency" *IEEE Transactions on Antennas and Propagation*; vol. 56, No. 1; pp. 248-252; Jan. 2008.

Ramadurgakar, Ameya "X Band Substrate Integrated Horn Array Antenna for Future Advanced Collison Avoidance System" Drexel University; 133 pages; 2011.

Schoenlinner, Bernhard "Compact Wide Scan-Angle Antennas for Automotive Applications and RF MEMS Switchable Frequency-Selective Surfaces" 2014.

WIDE FIELD OF VIEW VOLUMETRIC SCAN AUTOMOTIVE RADAR WITH END-FIRE ANTENNA

BACKGROUND

1. Field

The present disclosure relates to vehicular radar systems and, in particular, to a vehicular radar system having multiple end-fire antenna arrays stacked above each other for performing a volumetric scan and multiple end-fire antenna arrays oriented in different directions to increase a field of view of the vehicular radar systems.

2. Description of the Related Art

Autonomous and semi-autonomous vehicle functions are increasing in use. For example, some vehicle manufacturers are currently designing fully autonomous and semi-autonomous vehicles that can drive themselves from a starting location to a destination location. Some other vehicles include collision avoidance features that may warn a driver and/or control operations of a vehicle when detected data indicates that the vehicle may collide with another object. Algorithms for these autonomous and semi-autonomous vehicle features are based on detection of objects in the vicinity of the vehicle, such as street signs, other vehicles, people, and the like.

Many vehicles incorporate radar systems to detect such objects. Vehicular radar systems transmit a radar signal having a frequency of about 80 gigahertz (GHz) through the air. The radar signal is reflected from a target and the reflected signals or waves are then received by the vehicular radar system. The characteristics of the reflected signals are analyzed by a processor or a controller to determine characteristics of the objects that reflected the signal, such as a size of the object, a distance between the object and the vehicle, or the like.

Vehicular radar systems are relatively expensive to manufacture and require space on the vehicle for mounting. Traditional vehicular radar systems are designed to scan in only one direction, resulting in a limited field of view. Thus, when using traditional vehicular radar systems, multiple systems should be placed around a perimeter of a vehicle in order to detect data in all directions from the vehicle. As the quantity of vehicular radar systems placed on a vehicle increases, the total cost of the vehicle increases due to the cost to manufacture each system. Furthermore, as the quantity of vehicular radar systems placed on the vehicle increases, more area of the vehicle is required for mounting the radar systems. Vehicles have limited mounting space and, thus, it is desirable to reduce a quantity of components mounted on the vehicle.

Thus, there is a need for systems and methods for increasing a field of view of a vehicular radar system in order to reduce a number of vehicular radar systems positioned on a vehicle.

SUMMARY

Described herein is a vehicular radar system for performing a volumetric scan of an environment of a vehicle. The vehicular radar system includes a plurality of end-fire antennas. The plurality of end-fire antennas includes a first array of end-fire antennas positioned along a first plane and having a transmission end oriented in a first direction. The plurality of end-fire antennas also includes a second array of end-fire antennas positioned along the first plane and having a transmission end oriented in a second direction that is different than the first direction. The plurality of end-fire antennas also includes a third array of end-fire antennas positioned along a second plane above or below the first plane and having a transmission end oriented in the first direction. The plurality of end-fire antennas also includes a fourth array of end-fire antennas positioned along the second plane and having a transmission end oriented in the second direction. The vehicular radar system also includes at least one radio frequency integrated circuit (RFIC) coupled to the plurality of end-fire antennas and designed to control the plurality of end-fire antennas to scan for objects in the first direction, the second direction, and between the first direction and the second direction by transmitting signals of varying phases to the plurality of end-fire antennas.

Also described is a vehicle capable of three-dimensional scanning of an environment of the vehicle. The vehicle includes a plurality of end-fire antennas. The plurality of end-fire antennas includes a first array of end-fire antennas positioned along a first plane and having a transmission end oriented in a first direction. The plurality of end-fire antennas also includes a second array of end-fire antennas positioned along the first plane and having a transmission end oriented in a second direction that is different than the first direction. The plurality of end-fire antennas also includes a third array of end-fire antennas positioned along a second plane above or below the first plane and having a transmission end oriented in the first direction. The plurality of end-fire antennas also includes a fourth array of end-fire antennas positioned along the second plane and having a transmission end oriented in the second direction. The vehicle also includes at least one radio frequency integrated circuit (RFIC) coupled to the plurality of end-fire antennas. The RFIC is designed to receive signals from the plurality of end-fire antennas and to control the plurality of end-fire antennas to scan for objects in the first direction, the second direction, and between the first direction and the second direction by transmitting signals of varying phases to the plurality of end-fire antennas. The vehicle also includes an electronic control unit (ECU) coupled to the at least one RFIC and is designed to determine characteristics of an object in the environment based on the signals received by the at least one RFIC.

Also described is a vehicular radar system for performing a volumetric scan of an environment of a vehicle. The vehicular radar system includes a plurality of end-fire antennas. The plurality of end-fire antennas includes a first array of end-fire antennas positioned along a first plane and having a transmission end oriented in a first direction. The plurality of end-fire antennas also includes a second array of end-fire antennas positioned along the first plane and having a transmission end oriented in a second direction that is different than the first direction. The plurality of end-fire antennas also includes a third array of end-fire antennas positioned along a second plane above or below the first plane and having a transmission end oriented in the first direction. The plurality of end-fire antennas also includes a fourth array of end-fire antennas positioned along the second plane and having a transmission end oriented in the second direction. The vehicular radar system also includes a first radio frequency integrated circuit (RFIC) coupled to the first array of end-fire antennas and designed to control the first array of end-fire antennas to scan for objects in the first direction and towards the second direction from the first direction. The vehicular radar system also includes a second RFIC coupled to the second array of end-fire antennas and designed to control the second array of end-fire antennas to scan for objects in the second direction and towards the first direction from the second direction. The vehicular radar system also includes a third RFIC coupled to the third array of end-fire antennas and designed to control the third array of end-fire antennas to scan for objects in the first direction and towards the second direction from the first direction. The vehicular radar system also includes a fourth RFIC coupled to the fourth array of end-fire antennas and designed to control the fourth array of end-fire antennas to scan for objects in the second direction and towards the first direction from the second direction.

BRIEF DESCRIPTION OF THE DRAWINGS

Other systems, methods, features, and advantages of the present invention will be or will become apparent to one of ordinary skill in the art upon examination of the following figures and detailed description. It is intended that all such additional systems, methods, features, and advantages be included within this description, be within the scope of the present invention, and be protected by the accompanying claims. Component parts shown in the drawings are not necessarily to scale, and may be exaggerated to better illustrate the important features of the present invention. In the drawings, like reference numerals designate like parts throughout the different views, wherein:

DETAILED DESCRIPTION

The present invention provides vehicular radar systems. An exemplary vehicular radar system may include multiple radar boards. Each radar board may have a first antenna array oriented in a first direction. The radar boards may be stacked such that each antenna array is at least one of above or below a corresponding antenna array of an adjacent board. This stacking allows the vehicular radar system to detect three-dimensional data regarding the environment. Each radar board may also have a second antenna array that is oriented in a second direction that is different than the first direction. Inclusion of multiple antenna arrays oriented in different directions allows the vehicular radar system to scan in multiple directions at any given time, which increases the field of view of the vehicular radar system. The vehicular radar system may also include at least one camera for detecting image data. An ECU of the vehicle may receive the radar data and the image data and verify or supplement the radar data with the image data. The vehicular radar system may be used in autonomous and non-autonomous vehicles for detection of objects in the environment of the vehicle. The detected data may be used by the ECU to safely maneuver the vehicle on a road.

The vehicular radar system provides several benefits and advantages. One such advantage is that the vehicular radar system can simultaneously perform a three-dimensional scan in multiple directions. This is advantageous because it increases a field of view of the vehicular radar system, which in turn allows the vehicle to scan the same area or a greater area with fewer radar systems. Because the vehicle can scan at least the same area with fewer radar systems, an overall cost of the vehicle is reduced and less space in the vehicle is required for mounting radar systems. Furthermore, because fewer radar systems are positioned on the vehicle, the aesthetic appeal of the vehicle is increased. The vehicular radar systems also provide the benefit and advantage of detecting both radar data and image data. This is beneficial because objects detected using radar data may be verified using the image data and vice versa. Because the radar antennas and the camera are positioned on the same device, it is relatively easy to compare the data detected by each because the distance between the antennas and the camera is minimal.

Figure 1:
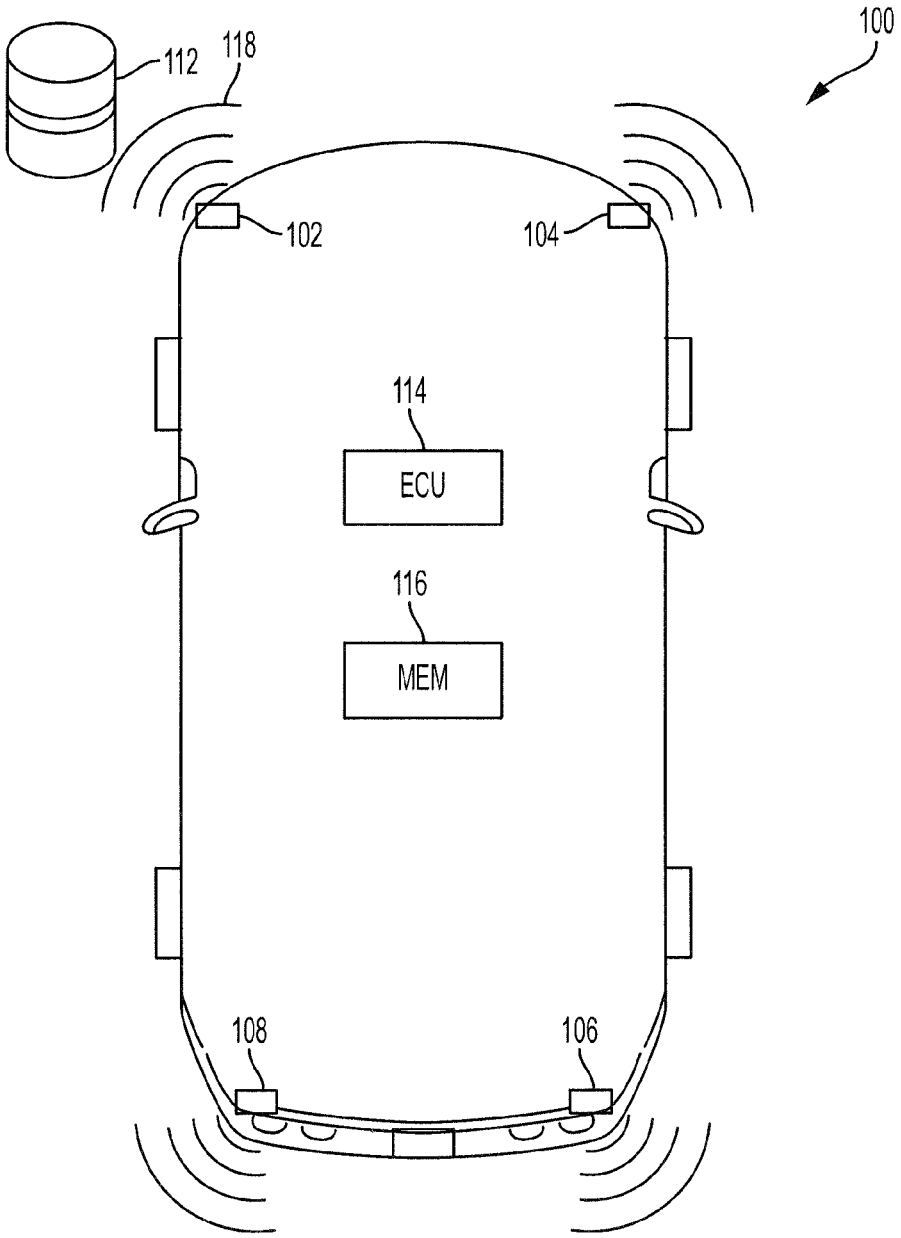
FIG. 1 is a drawing of a vehicle having multiple vehicular radar systems for sensing objects in an environment of the vehicle according to an embodiment of the present invention.

Turning to FIG. 1, a vehicle 100 having radar sensing capabilities is shown. The vehicle 100 includes a first vehicular radar system 102, a second vehicular radar system 104, a third vehicular radar system 106, and a fourth vehicular radar system 108. Each of the vehicular radar systems 102, 104, 106, 108 may detect data corresponding to characteristics of objects around the vehicle 100 such as a distance to the object, a size of the object, or the like. For example, the vehicular radar system 102 may transmit a signal or a beam 118. The beam 118 may reflect off of an object 112 and propagate back towards the vehicular radar system 102. The vehicular radar system 102 may receive the reflected signal and characteristics of the object 112 may be determined based on the received reflected signal.

In order to detect radar data with relatively high accuracy and over a relatively large area, it is desirable for each of the vehicular radar systems 102, 104, 106, 108 to have a relatively large field of view. Thus, each of the vehicular radar systems 102, 104, 106, 108 may include radar antennas oriented in different directions. For example, each of the vehicular radar systems 102, 104, 106, 108 may include radar antennas oriented in two different directions, allowing the vehicular radar systems 102, 104, 106, 108 to each detect data within a 240 degree field of view. This allows data to be detected in all directions from the vehicle 100 using the four vehicular radar systems 102, 104, 106, 108.

It is also desirable for each of the vehicular radar systems 102, 104, 106, 108 to detect volumetric, or three-dimensional, data corresponding to objects in the environment. As will be described with greater detail below, the vehicular radar systems 102, 104, 106, 108 have been designed to have multiple antennas of a particular type positioned adjacent to each other in two directions to provide for volumetric scanning.

In some embodiments, the vehicle 100 may also include one or more cameras (not shown). The cameras may detect image data corresponding to objects in the environment of the vehicle 100. To ensure that the radar data and the image data correspond to a same location, it may be desirable to calibrate the image data and the radar data. For optimal calibration, it is desirable for the image data and the radar data to be detected from a single location. Thus, in some embodiments, one or more of the vehicular radar systems 102, 104, 106, 108 may include one or more camera. Including cameras in the vehicular radar systems 102, 104, 106, 108 provides additional advantages such as reducing a total cost of a sensor package of the vehicle 100. This is because fewer total mounting points for sensors will be required on the vehicle 100 and fewer sensing units will need to be purchased or manufactured for the vehicle 100.

The vehicle 100 may also include an electronic control unit (ECU) 114 and a memory 116. In some embodiments, the ECU 114 may include a logic device, such as a processor, FPGA, or the like, specifically designed to perform functions that correspond to operations of the vehicle 100. The memory 116 may include any non-transitory memory capable of storing data. For example, the memory 116 may store instructions to be performed by the ECU 114, may store data usable by the ECU 114 to identify characteristics of objects based on radar and/or image data, or the like.

The ECU 114 may be coupled to each of the vehicular radar systems 102, 104, 106, 108, including any cameras positioned therein. The ECU 114 may receive radar data and image data corresponding to objects in the environment. The ECU 114 may determine the presence of and characteristics of an object, such as the object 112, based on the radar data. The ECU 114 may also determine characteristics of the object 112 based on the image data. The ECU 114 may verify the characteristics of the object 112 that were determined based on the radar data using the received image data. The ECU 114 may also supplement the characteristics of the object 112 that were determined based on the radar data using the received image data. For example, the ECU 114 may determine that the object 112 is 5 feet away from the vehicle 100 based on the radar data and may determine that the object 112 has a height of 3 feet based on the image data.

Figure 2A:
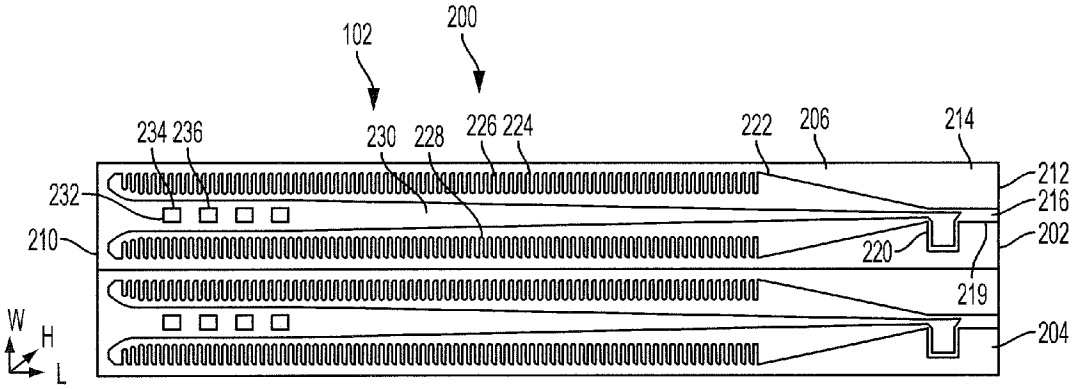
FIG. 2A is a drawing showing a top view of two end-fire antennas of an end-fire antenna array according to an embodiment of the present invention.
Figure 2B:
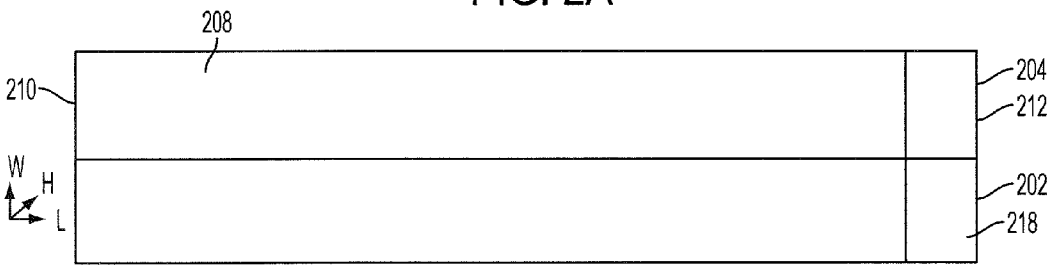
FIG. 2B is a drawing showing a bottom view of the end-fire antenna array of FIG. 2A according to an embodiment of the present invention.
Figure 2C:
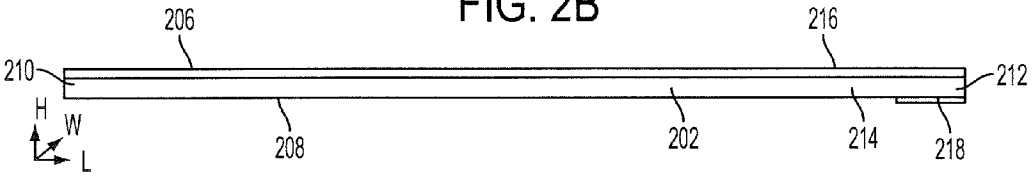
FIG. 2C is a drawing showing a side view of the end-fire antenna array of FIG. 2A according to an embodiment of the present invention.

Turning now to FIGS. 2A, 2B, and 2C, a top view, a bottom view, and a side view, respectively, of an end-fire antenna array 200 are shown. The end-fire antenna array 200 may be included in the vehicular radar system 102. An L-W-H axis is shown in various drawings to illustrate directions corresponding to a length, a width, and a height of the vehicular radar system 102. Although features are described with reference to the length, the width, and the height, one skilled in the art will realize that the vehicular radar system 102 may be oriented in any direction such that, for example, a height may be referred to as a length and so forth.

The end-fire antenna array 200 has a plurality of end-fire antennas including a first end-fire antenna 202 and a second end-fire antenna 204. In some embodiments, the antenna array 200 may include between 2 and 32 end-fire antennas.

The antenna array 200, and thus the first antenna 202 and the second antenna 204, has a top 206 and a bottom 208. The terms top and bottom are used for reference only. One skilled in the art will realize that the top 206 and the bottom 208 of the antenna array 200 may be oriented in any direction.

The first antenna 202 may include a metal 216 inside of or on a PCB 214. The metal 216 may be, for example, a metal trace printed on the PCB 214. The first antenna 202 includes a transmission end 210 and a chip connection end 212. The transmission end 210 is an end of the first antenna 202 from which signals propagate into the atmosphere. The chip connection end 212 is an end of the first antenna 202 from which a signal propagates from an RFIC towards the first antenna 202.

A signal from a controller, such as an RFIC designed to transmit signals in a radio frequency, may be received by the first antenna 202 at the chip connection end 212. The signal may propagate through the first antenna 202 towards the transmission end 210. From the transmission end, the signal may be wirelessly transmitted into the atmosphere in the longitudinal direction (i.e., in the negative L direction).

Similarly, a wireless signal (such as a signal reflected off of an object) may be received by the first antenna 202 at the transmission end 210 and may propagate through the first antenna 202 to the chip connection end 212. The signal may then be received by the controller and analyzed by the controller to determine features of the object from which it was reflected.

The metal 216 of the first antenna 202 may include tin, gold, nickel, any other conductive metal, or any combination thereof. The metal 216 on the bottom 208 of the first antenna 202 may form a ground structure 218. The ground structure 218 may be electrically isolated from the metal 216 on the top 206 of the first antenna 202 and may be connected to an electrical ground.

The metal 216 on the top 206 of the first antenna 202 may form an antenna structure including a chip connection lead 219, a balun 220, a tapered section 222, and a wave section 224. In some embodiments, the metal 216 on the top 206 of the first antenna 202 may also form one or more beam adjustment feature 232 including a first beam adjustment feature 234 and a second beam adjustment feature 236. The first antenna 202 and the second antenna 204 may each be referred to as tapered slot end-fire antennas.

The chip connection lead 219 may be electronically connected to a controller, such as an RFIC, that controls operation of the antenna array 200.

The balun 220 may function as a transformer and convert an unbalanced signal to a balanced signal and/or may convert a balanced signal to an unbalanced signal.

The tapered section 222 is tapered from the wave section 224 to the balun 220. The converted signal may propagate through the tapered section 222 towards the wave section 224.

The wave section 224 may include a first wave section 226 and a second wave section 228 separated by a space 230. The design of the wave section 224 allows the signal propagating towards the transmission end 210 to continue to propagate beyond the wave section 224 in a wireless manner.

The beam adjustment features 232 may be included or adjusted to alter characteristics of a signal transmitted by the first antenna 202. The beam adjustment features 232 may be positioned within the space 230. The beam adjustment features 232 may have any shape such as the square shape that is shown, a triangular shape, a parallelogram shape, or the like. The beam adjustment features 232 may be electrically isolated from the other metal 216 on the top 206 of the first antenna 202 or may be in electrical contact with the other metal 216.

Figure 2D:
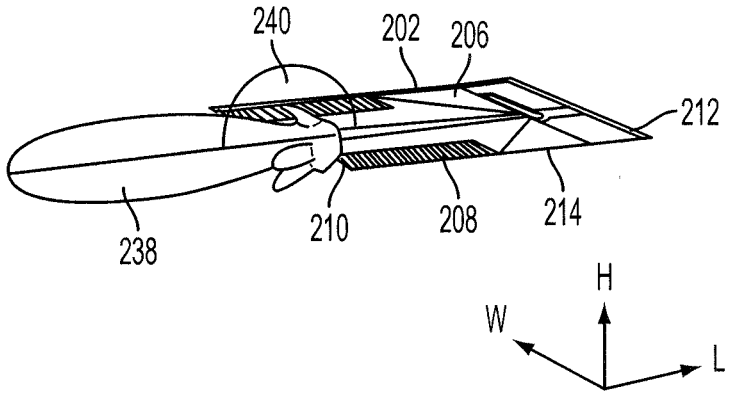
FIG. 2D is a drawing illustrating a shape of a radar beam transmitted by one of the end-fire antennas of FIG. 2A according to an embodiment of the present invention.

Turning to FIG. 2D, the first antenna 202 functions as an end-fire antenna because it transmits a signal or a beam 238 that propagates in a direction parallel to a longitudinal direction of the first antenna 202 (i.e., in the negative L direction). This is distinguished from a signal transmitted by a broadside antenna that propagates perpendicular to a longitudinal direction of an antenna (i.e., in the positive H direction).

Referring to FIGS. 2A and 2D, the beam adjustment features 232 may be varied to adjust characteristics of the beam 238. For example, a quantity of the beam adjustment features 232, a shape of the beam adjustment features 232, and/or dimensions of the beam adjustment features 232 may be selected to achieve desirable characteristics of the beam 238. In some embodiments, the quantity, the shape, and/or the dimensions of the beam adjustment features 232 may be selected in order for the beam 238 to form a desired angle 240 with the top 206 or the bottom 208 of the PCB 214.

Returning reference to FIGS. 2A, 2B, and 2C, bandwidths for automotive radar systems may be about 80 gigahertz (GHz), such as between 77 GHz and 79 GHz. Where used in this context, "about" refers to the referenced value plus or minus seven percent (7%). The end-fire antennas provide desirable characteristics at these bandwidths. The end-fire antennas may be positioned adjacent to each other, as shown in FIG. 2A, in order to form a beam that scans in two dimensions. Furthermore, because the signal propagates away from the antenna in the longitudinal direction, the end-fire antennas may be stacked on top of each other, allowing for a volumetric (three-dimensional) scan.

In order to obtain desirable antenna properties of signals having bandwidths in the automotive spectrum, the substrate of the antenna array 200 (i.e., the PCB 214) may be relatively thin. For example, the first antenna 202 (including the PCB 214) may have a height of 0.127 mm in the H direction, a width of 2.5 mm in the W direction, and a length of 10 mm to 30 mm in the L direction.

Figure 3:
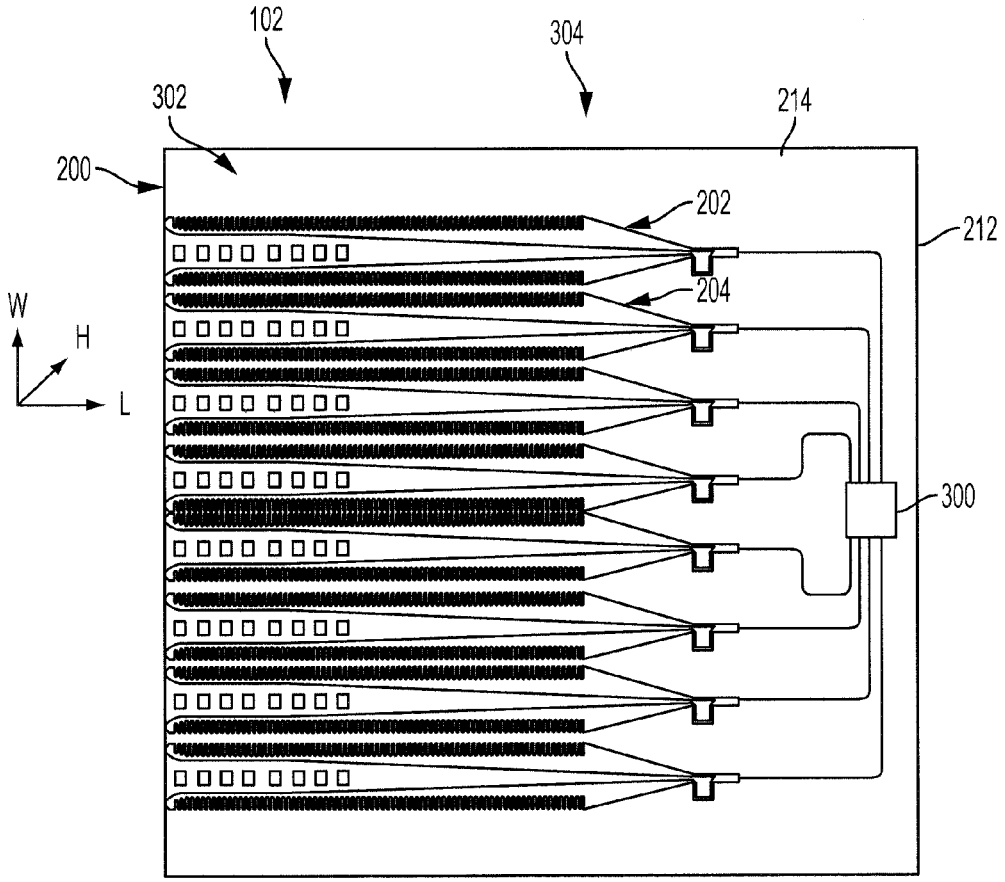
FIG. 3 is a drawing illustrating a radar subsystem having the end-fire antenna array of FIG. 2A and a radio frequency integrated circuit (RFIC) coupled to the end-fire antenna array according to an embodiment of the present invention.

Turning now to FIG. 3, the vehicular radar system 102 may include a radar subsystem 304. The radar subsystem 304 may include the end-fire antenna array 200 that includes a plurality of end-fire antennas 302. The radar subsystem 304 may also include an RFIC 300. The RFIC 300 may be connected to each of the plurality of end-fire antennas 302 of the end-fire antenna array 200. The RFIC 300 may be connected to the PCB 214, and thus the plurality of end-fire antennas 302, in any of a variety of manners such as flipchip bonding, wire bonding, or the like.

The RFIC 300 may control operation of each of the plurality of end-fire antennas 302. For example, the RFIC 300 may transmit a signal to each antenna of the plurality of end-fire antennas 302, which in turn may be wirelessly transmitted by the corresponding antenna.

The RFIC 300 may control the plurality of end-fire antennas 302 to transmit one or more radar beam. For example, at least some of the signals transmitted by the RFIC 300 to each of the plurality of end-fire antennas 302 may have a different phase. When the signals have a different phase and are transmitted into the atmosphere, the combined signals form a radar beam.

When the beam reaches an object away from the radar subsystem 304, the beam may reflect from the object and travel towards the radar subsystem 304. The reflected beam may be received by the end-fire antennas 302 and/or other end-fire antennas and may be transmitted from the antennas to the RFIC 300. In some embodiments, the RFIC 300 may analyze the received beam that was reflected from the object and determine characteristics of the object based on the reflected beam. In some embodiments, the RFIC 300 may relay the received beam to another processing unit, such as the ECU 114 of FIG. 1.

Because the antennas 302 of the radar subsystem 304 are positioned in a linear manner with respect to each other, the radar subsystem 304 may scan in two dimensions. When two or more two-dimensional radar boards are stacked such that antennas are positioned in two directions with respect to each other, the radar boards may together scan in three dimensions.

Figure 4:
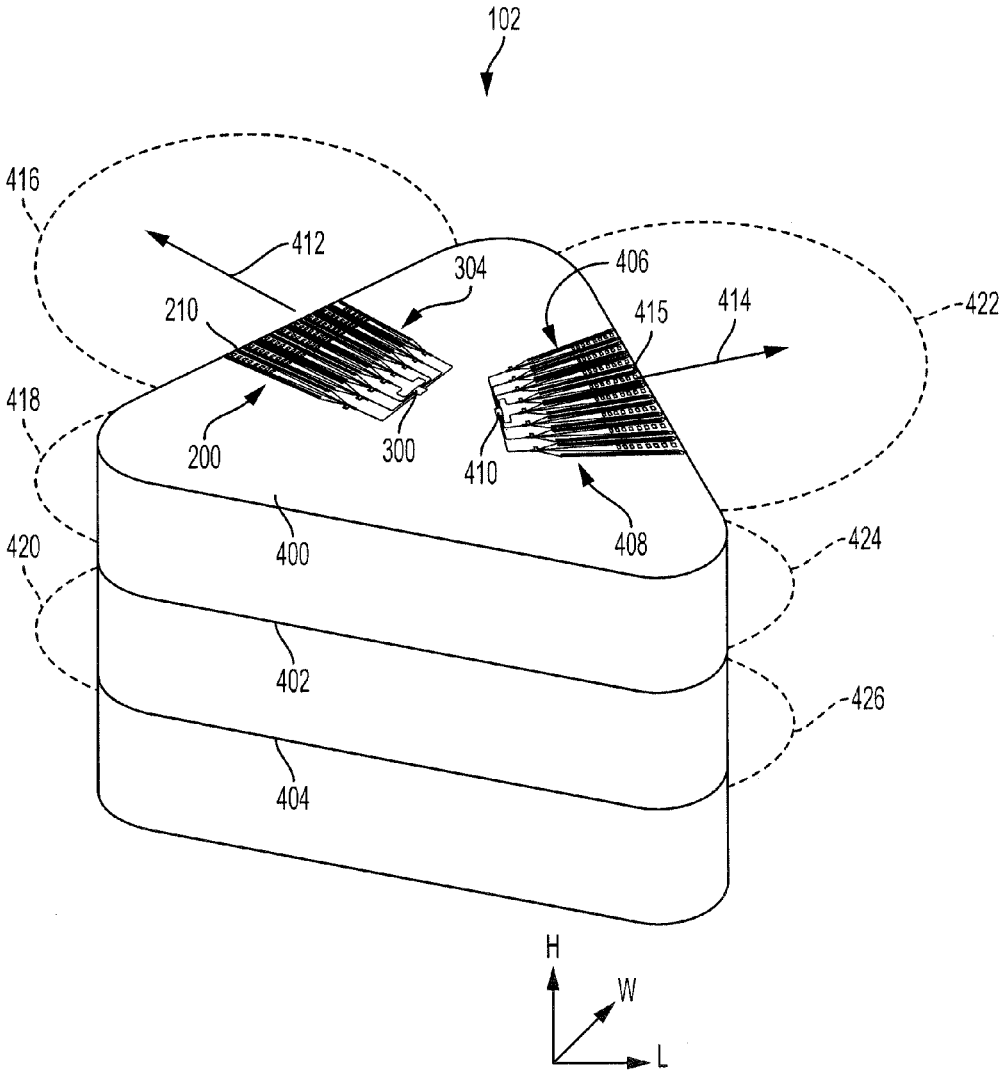
FIG. 4 is a drawing of a vehicular radar system having multiple radar boards that are each capable of scanning in two directions at any given time according to an embodiment of the present invention.

Turning now to FIG. 4, the vehicular radar system 102 may include multiple radar subsystems. In particular, the vehicular radar system 102 includes a first two direction radar board 400, a second two direction radar board 402, and a third two direction radar board 404.

The first two direction radar board 400 includes the radar subsystem 304 and another radar subsystem 406. The radar subsystem 406 includes similar components as the radar subsystem 304. In particular, the radar subsystem 406 includes an end-fire antenna array 408 and an RFIC 410 coupled to the end-fire antenna array 408.

The radar subsystem 304 and the radar subsystem 406, including their components, are each positioned on the PCB 206. The PCB 206 is positioned along a plane that is parallel to the W-L plane.

The transmission end 210 of the end-fire antenna array 200 of the first radar subsystem 304 is oriented in a first direction 412 and a transmission end 415 of the end-fire antenna array 408 is oriented in a second direction 414 that is different than the first direction 412. In some embodiments, the RFIC 300 of the first radar subsystem 304 is designed to control the end-fire antenna array 200 to scan 60 degrees both ways from the first direction 412 along the L-W plane. Thus, the first radar subsystem 304 may have a field of view of 120 degrees. The second radar subsystem 406 may also have a field of view of 120 degrees. In some embodiments, the first direction 412 and the second direction 414 may be spaced apart by 120 degrees along the L-W plane. This results in the first two direction radar board 400 being capable of detecting objects within a 240 degree field of view.

The ability for a single radar board to detect objects within a 240 degree field of view is advantageous because a vehicle using such a radar board may have fewer total sensors than other vehicles. This reduces a total cost of the vehicle because a single PCB with two radar subsystems is less expensive to manufacture than two PCBs each having a single radar subsystem. Inclusion of multiple radar subsystems on a single PCB also reduces an amount of space on the vehicle required for mounting radar systems. This is desirable because usable space for adding components on vehicles is limited. Inclusion of multiple radar systems on a single radar board also provides the advantage of a reduced amount of processing to analyze the detected data because the data will be detected from a single point on the vehicle instead of multiple points.

Each of the second two direction radar board 402 and the third two direction radar board 404 also have a radar subsystem stacked below the radar subsystem 304 and a radar subsystems stacked below the radar subsystem 406. In that regard, the second two direction radar board 402 and the third two direction radar board 404 each have an end-fire antenna array oriented in the first direction 412. Thus, the end-fire antenna array 200 of the first two direction radar board 400 can transmit a first radar beam 416 in the first direction 412.

Likewise, the corresponding end-fire antenna arrays of the second two direction radar board 402 and the third two direction radar board 404 can transmit a second radar beam 418 and a third radar beam 420, respectively, in the first direction 412. Data detected based on the first radar beam 416, the second radar beam 418, and the third radar beam 420 may be assembled to determine three-dimensional data. Stated differently, the first radar beam 416, the second radar beam 418, and the third radar beam 420 may provide a volumetric scan in the first direction 412.

Although three (3) two direction radar boards are shown, the vehicular radar system 102 may include any number of two direction radar boards. Inclusion of additional two direction radar boards may increase a quality of volumetric scanning.

Similarly, the end-fire antenna array 408 of the first two direction radar board 400 may transmit a first radar beam 422 in the second direction 414. The corresponding end-fire antenna arrays of the second two direction radar board 402 and the third two direction radar board 404 may transmit a second radar beam 424 and a third radar beam 426, respectively, in the second direction 414. Thus, the vehicular radar system 102 may also provide a volumetric scan in the second direction 414.

In some embodiments, fewer RFICs may be included in the vehicular radar system 102. For example, the first two direction radar board 400 may include a single RFIC coupled to the first end-fire antenna array 200 and the second end-fire antenna array 408. Each of the second two direction radar board 402 and the third two direction radar board 404 may have a single RFIC as well. As another example, the vehicular radar system 102 may include a first RFIC coupled to the end-fire antenna array 200 and the corresponding end-fire antenna arrays of the second two direction radar board 402 and the third two direction radar board 404. The vehicular radar system 102 may also include a second RFIC coupled to the end-fire antenna array 408 and the corresponding end-fire antenna arrays of the second two direction radar board 402 and the third two direction radar board 404. As yet another example, the vehicular radar system 102 may include a single RFIC coupled to all of the end-fire antenna arrays.

Figure 5:
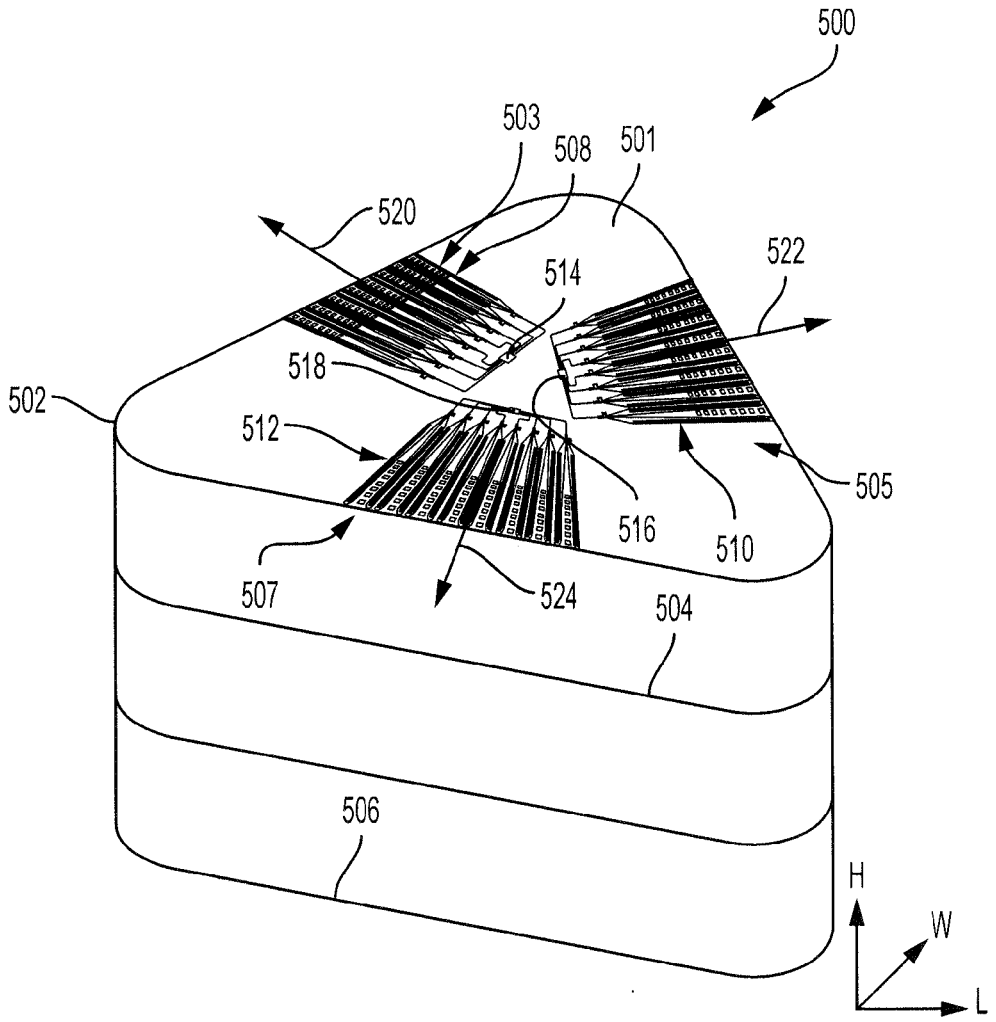
FIG. 5 is a drawing of a vehicular radar system having multiple radar boards that are each capable of scanning in three directions at any given time according to an embodiment of the present invention.

Turning now to FIG. 5, another vehicular radar system 500 is shown. The vehicular radar system 500 is capable of performing a volumetric scan in three different directions and includes a first three direction radar board 502, a second three direction radar board 504, and a third three direction radar board 506. The first three direction radar board 502 includes a first radar subsystem 503, a second radar subsystem 505, and a third radar subsystem 507.

The first radar subsystem 503 includes a first end-fire antenna array 508 and a first RFIC 514. The first end-fire antenna array 508 is oriented in a first direction 520 along the L-W plane. The second radar subsystem 505 includes a second end-fire antenna array 510 and a second RFIC 516. The second end-fire antenna array 510 is oriented in a second direction 522 along the L-W plane. The third radar subsystem 507 includes a third end-fire antenna array 512 and a third RFIC 518. The third end-fire antenna array 512 is oriented in a third direction 524 along the L-W plane. Each of the first radar subsystem 503, the second radar subsystem 505, and the third radar subsystem 507 may be printed on a single PCB 501. In some embodiments, the first radar subsystem 503, the second radar subsystem 505, and the third radar subsystem 507 may be printed on separate PCBs.

Each of the second three direction radar board 504 and the third three direction radar board 506 includes three radar subsystems, one stacked beneath the first radar subsystem 503, the second radar subsystem 505, and the third radar subsystem 507 of the first three direction radar board 502. Accordingly, the vehicular radar system 500 may perform a volumetric scan in each of the first direction 520, the second direction 522, and the third direction 524.

In some embodiments, each of the radar subsystems may be capable of scanning 120 degrees along the L-W plane. The vehicular radar system 500 may be designed such that the first direction 520, the second direction 522, and the third direction 524 are each separated by 120 degrees along the L-W plane. This orientation of the antenna arrays allows the vehicular radar system 500 to perform a volumetric scan in 360 degrees about the L-W plane.

Figure 6:
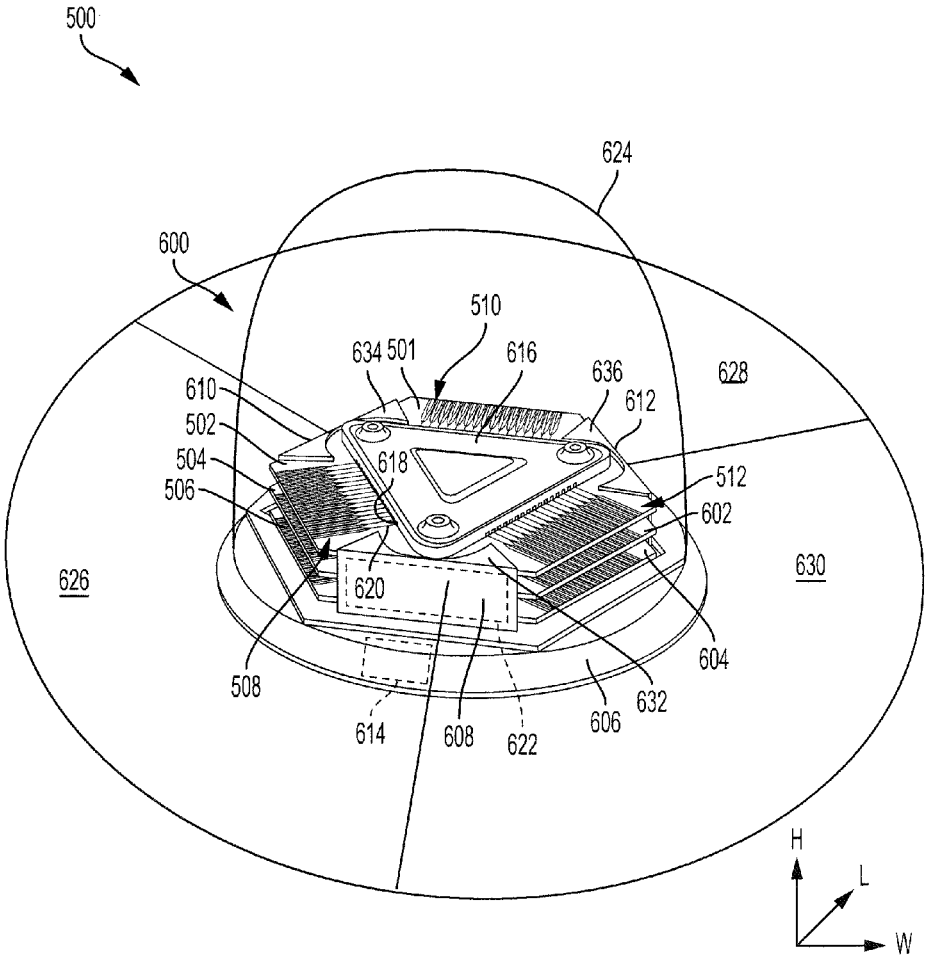
FIG. 6 is a drawing of the vehicular radar system of FIG. 5 including a radar mount for housing the three direction radar boards according to an embodiment of the present invention.

Turning now to FIG. 6, the vehicular radar system 500 may include a radar mount 600 for supporting the various components of the vehicular radar system 500. Similar to the vehicular radar system 102 of FIG. 4, each of the first three direction radar board 502, the second three direction radar board 504, and the third three direction radar board 506 may include a PCB. In particular, the components of the first three direction radar board 502 may be positioned on the PCB 501. The components of the second three direction radar board 504 may be positioned on a second PCB 602. The components of the third three direction radar board 506 may be positioned on a third PCB 604.

The radar mount 600 may include a base 606 upon which the vehicular radar system 500 may be positioned along the L-W plane. The radar mount 600 may also include a first wall 608, a second wall 610, and a third wall 612 coupled to the base 606. The first wall 608, the second wall 610, and the third wall 612 may extend in the H direction from the base 606. The base 606 and the walls 608, 610, 612 may each include one or more of a metal, a plastic, a composite material, or the like. The base 606 may resemble a relatively flat cylinder as shown, a portion of a cone, a rectangle, a triangle, or other shape. Likewise, each of the walls 608, 610, 612 may resemble a triangular prism as shown, a rectangular prism, or another shape.

The vehicular radar system 500 may also include a radar processor 614. In some embodiments, the base 606 may define a cavity (not shown) in which the radar processor 614 is positioned. The radar processor 614 may be coupled to each RFIC of the vehicular radar system 500 and may receive data from each RFIC.

The radar processor 614 may include one or more of an analog to digital converter, a memory, a port to connect to another network of the vehicle, a processor, an FPGA, or any other decision-making logic. The radar processor 614 may receive the signals received from the antennas of the vehicular radar system 500 via each RFIC and may process the signals received from each RFIC. The radar processor 614 may at least one of convert the signals into digital format, determine characteristics of a detected object based on the signals, determine a direction or directions corresponding to the received signals, combine multiple signals into fewer signals, transfer the received signals to an ECU (e.g., ECU 114) of the vehicle, or the like. In that regard, the ECU may receive signals directly from each RFIC, may receive signals from the radar processor 614, or may receive signals from each RFIC and the radar processor 614.

The radar mount 600 may also include a cover 616. In some embodiments, the cover 616 may include metal. The cover 616 may be designed to rest above each RFIC in the H direction. This positioning of the cover 616 above each RFIC reduces the likelihood of undesired signals propagating into the atmosphere from any RFIC. This positioning of the cover 616 also reduces the likelihood of signals from the atmosphere interfering with signals received or transmitted by any RFIC.

The cover 616 may also be designed to be positioned towards a center of each PCB 501, 602, 604 from a balun of each antenna of the end-fire antenna arrays 508, 510, 512 and to not be positioned above the balun or any other features of each antenna besides leads 620. This positioning of the cover 616 reduces the likelihood of the cover 616 interfering with signals transmitted by each of the end-fire antenna arrays 508, 510, 512.

Each antenna may be coupled to a corresponding RFIC via one or more of the leads 620. The leads 620 may include a conductive material positioned on a corresponding PCB and connecting the antennas to a corresponding RFIC. The cover 616 may define a plurality of openings 618 each corresponding to one of the leads 620 of the first three direction radar board 502. The perimeter of the cover 616 may be in contact with the first PCB 501 with the exception of the openings 618. The openings 618 may define a space between the cover 616 and the first PCB 501 through which the leads 620 may extend. One opening may be present for each of the leads 620. The openings 618 may be designed in such a way that signals having a desirable bandwidth may pass through the openings 618 while also reducing the likelihood of signals having undesirable bandwidths passing through the openings 618.

The vehicular radar system 500 may also include one or more edgeboards coupled to each RFIC. For example, a first edgeboard 622 is positioned on the first wall 608 and is electrically coupled to the first PCB 501, the second PCB 602, and the third PCB 604. The first edgeboard 622 may include a PCB with conductive material and be electrically coupled to each RFIC via the corresponding PCB 501, 602, 604. The first edgeboard 622 may also be coupled to the radar processor 614. In that regard, data may transfer between each RFIC and the radar processor 614 via the corresponding PCB 501, 602, 604 and the edgeboard 622. In some embodiments, the second wall 610 and the third wall 612 may each include an edgeboard such that each edgeboard is connected to a single RFIC from each three direction radar board.

The radar mount 600 may also include a radome 624. The radome 624 may be positioned on the base 606 and may at least partially surround the first three direction radar board 502, the second three direction radar board 504, and the third three direction radar board 506. The radome 624 and may be designed to allow signals of a desirable bandwidth to pass through with minimal reflection or interference. The design of may include particular materials, a size of the radome 624, a shape of the radome 624, or the like. In some embodiments, the radome 624 may be designed to reduce the intensity of signals having undesirable bandwidths that reach the radome 624.

As described above, the vehicular radar system 500 may be designed to detect data within a 360 degree field of view. In that regard and with reference to FIGS. 5 and 6, the first RFIC 514 may control the first end-fire antenna array 508 to transmit signals within a first vector 626. For example, the first RFIC 514 may control the first end-fire antenna array 508 to scan from left to right and or from right to left within the first vector 626. The second RFIC 516 may control the second end-fire antenna array 510 to transmit signals within a second vector 628. The third RFIC 518 may control the third end-fire antenna array 512 to transmit signals within a third vector 630. The corresponding RFICs of the second three direction radar board 504 and the third three direction radar board 506 may control the corresponding pluralities of end-fire antennas to transmit signals in one of the three vectors 626, 628, 630.

Each of the first vector 626, the second vector 628, and the third vector 630 may correspond to a 120 degree field of view of the corresponding radar subsystems. As shown, each array of end-fire antennas is oriented 120 degrees apart from the other arrays of end-fire antennas on the same three direction radar board. Thus, as shown, the combination of the first vector 626, the second vector 628, and the third vector 630 correspond to 360 degrees around the vehicular radar system 500 along the L-W plane.

Returning reference to FIG. 6, the first wall 608 may define one or more flange 632, the second wall 610 may define one or more flange 634, and the third wall 612 may define one or more flange 636. Each of the flanges 632, 634, 636 may support one or more of the first PCB 501, the second PCB 602, and the third PCB 604. The flanges 632, 634, 636 may hold the PCBs 501, 602, 604 in a desired location within the radar mount 600. For example, the flanges 632, 634, 636 may cause the first PCB 501, the second PCB 602, and the third PCB 604 to be parallel to each other and separated by a sufficient distance that signals from antennas of each of the PCBs 501, 602, 604 do not interfere with each other.

Figure 7:
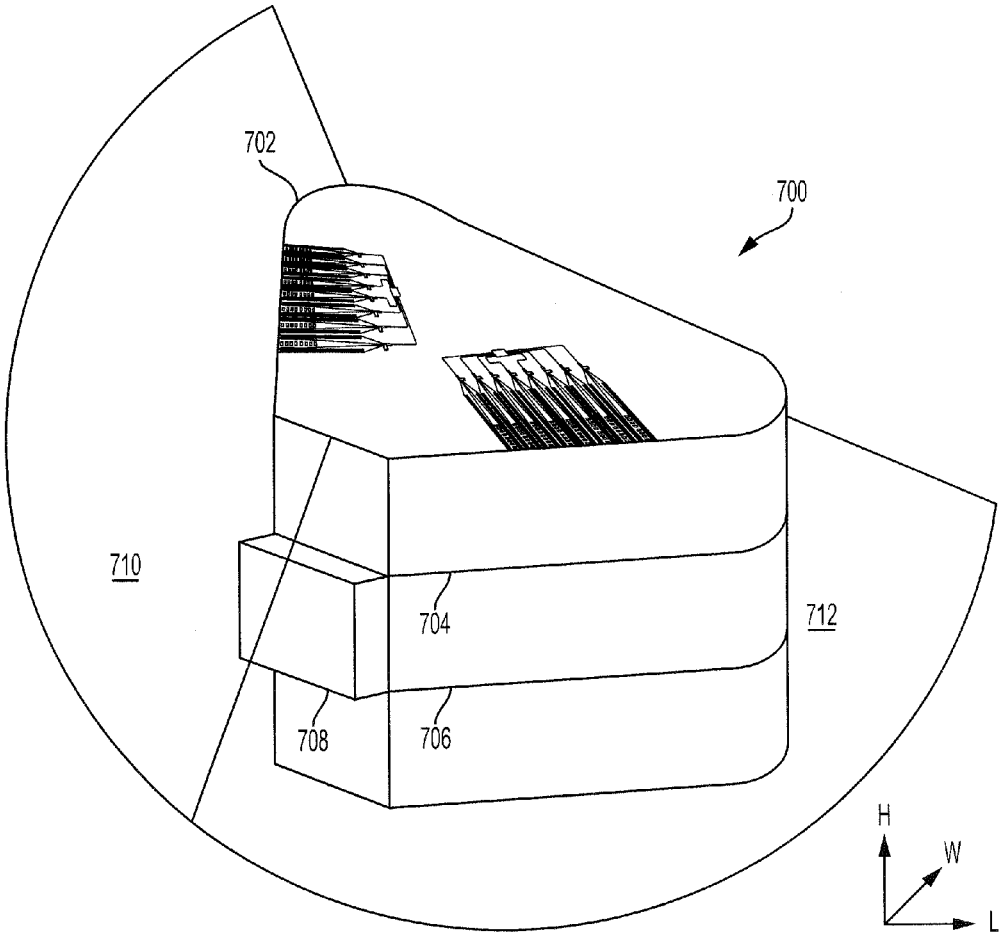
FIG. 7 is a drawing of a vehicular radar system having multiple two direction radar boards for detecting radar data along with a camera for detecting image data according to an embodiment of the present invention.

Turning now to FIG. 7, another vehicular radar system 700 is shown. The vehicular radar system 700 includes a first two direction radar board 702, a second two direction radar board 704, and a third two direction radar board 706. Each of the two direction radar boards 702, 704, 706 have a radar subsystem configured to scan a first vector 710 and a second vector 712. In some embodiments, each of the first vector 710 and the second vector 712 may be 120 degrees such that the vehicular radar system 700 can perform a volumetric scan in 240 degrees. In that regard, the vehicular radar system 700 is similar to the vehicular radar system 102 of FIG. 4.

In addition to having similar features as the vehicular radar system 102 of FIG. 4, the vehicular radar system 700 further includes a camera 708 coupled to the two direction radar boards 702, 704, 706. The camera 708 is configured to detect image data corresponding to an environment of the vehicular radar system 700. The camera 708 may be positioned at a center point between the transmission end of each radar subsystem along the L-W plane. The camera 708 may be a wide view camera such that it can detect objects positioned anywhere within the first vector 710 and the second vector 712. In some embodiments, the camera 708 may include multiple cameras oriented in different directions such that together the cameras may detect objects positioned anywhere within the first vector 710 and the second vector 712. In some embodiments, the camera 708 may rotate, allowing it to detect objects positioned anywhere within the first vector 710 and the second vector 712. In some embodiments, the camera 708 may be designed to detect data only within a portion of the first vector 710 and/or the second vector 712.

Because the vehicular radar system 700 is designed for use in a vehicle, each of the radar subsystems and the camera 708 may be coupled to an ECU (e.g., ECU 114). In some embodiments, the radar subsystems and the camera 708 may be directly coupled to the ECU and, in some embodiments, the radar subsystems and the camera 708 may be coupled to the ECU via an intermediary device or devices such as one or more radar processor.

The ECU of the vehicle, such as the ECU 114 of FIG. 1, may receive the radar data and the image data. The ECU may determine characteristics of an object in the environment based on the radar data and the image data. The ECU may use the determined characteristics that were based on the image data to verify or supplement the determined characteristics that were based on the radar data. In some embodiments, the ECU may instead use the determined characteristics that were based on the radar data to verify or supplement the determined characteristics that were based on the image data.

Figure 8:
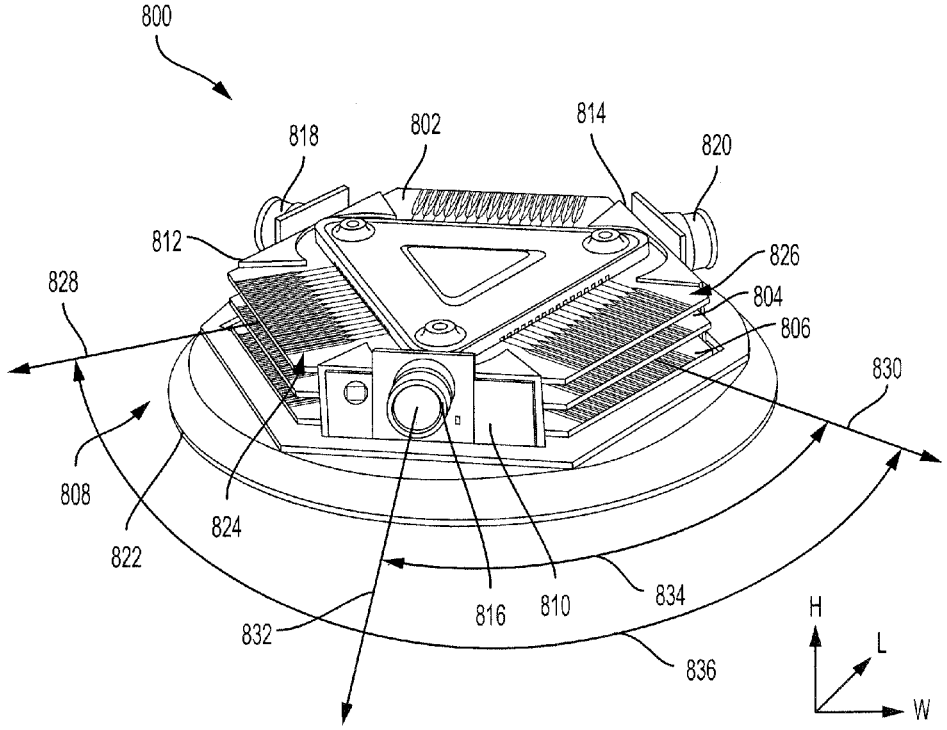
FIG. 8 is a drawing of a vehicular radar system having multiple three direction radar boards for detecting radar data and multiple cameras for detecting image data and a radar mount for housing the radar boards and the cameras according to an embodiment of the present invention.

Turning now to FIG. 8, another vehicular radar system 800 is shown. The vehicular radar system 800 includes a first three direction radar board 802, a second three direction radar board 804, and a third three direction radar board 806 each having three radar subsystems oriented in three directions. The vehicular radar system 800 further includes a radar mount 808. In that regard, the vehicular radar system 800 includes similar features as the vehicular radar system 500 of FIG. 6.

Similar to the radar mount 600 of FIG. 6, the radar mount 808 includes a first wall 810, a second wall 812, and a third wall 814 extending upwards from, and perpendicular to, a base 822. Unlike the vehicular radar system 500 of FIG. 6, however, the vehicular radar system 800 includes cameras positioned on the walls 810, 812, 814. In particular, the vehicular radar system 800 includes a first camera 816 positioned on the first wall 810, a second camera 818 positioned on the second wall 812, and a third camera 820 positioned on the third wall 814.

The cameras 816, 818, 820 may each be oriented in a direction directly between adjacent radar subsystems along the L-W plane. For example, a first radar subsystem 824 may be oriented in a first direction 828 and a second radar subsystem 826 may be oriented in a second direction 830. The first camera 816 may be oriented in a third direction 832. The direction 830 of the second radar subsystem 826 and the direction 832 of the first camera 816 may be separated by an angle 834 along the L-W plane. In some embodiments, the angle 834 may be 60 degrees. The direction 830 of the second radar subsystem 826 and the direction 828 of the first radar subsystem 824 may be separated by an angle 836 in the L-W plane. In some embodiments, the angle 836 may be 120 degrees.

The cameras 816, 818, 820 may be selected and positioned in such a way that they can detect image data in all directions from the vehicular radar system 800. In that regard, the vehicular radar system 800 can detect radar data and audio data in 360 degrees around the vehicular radar system 800 along the L-W plane.

Figure 9:
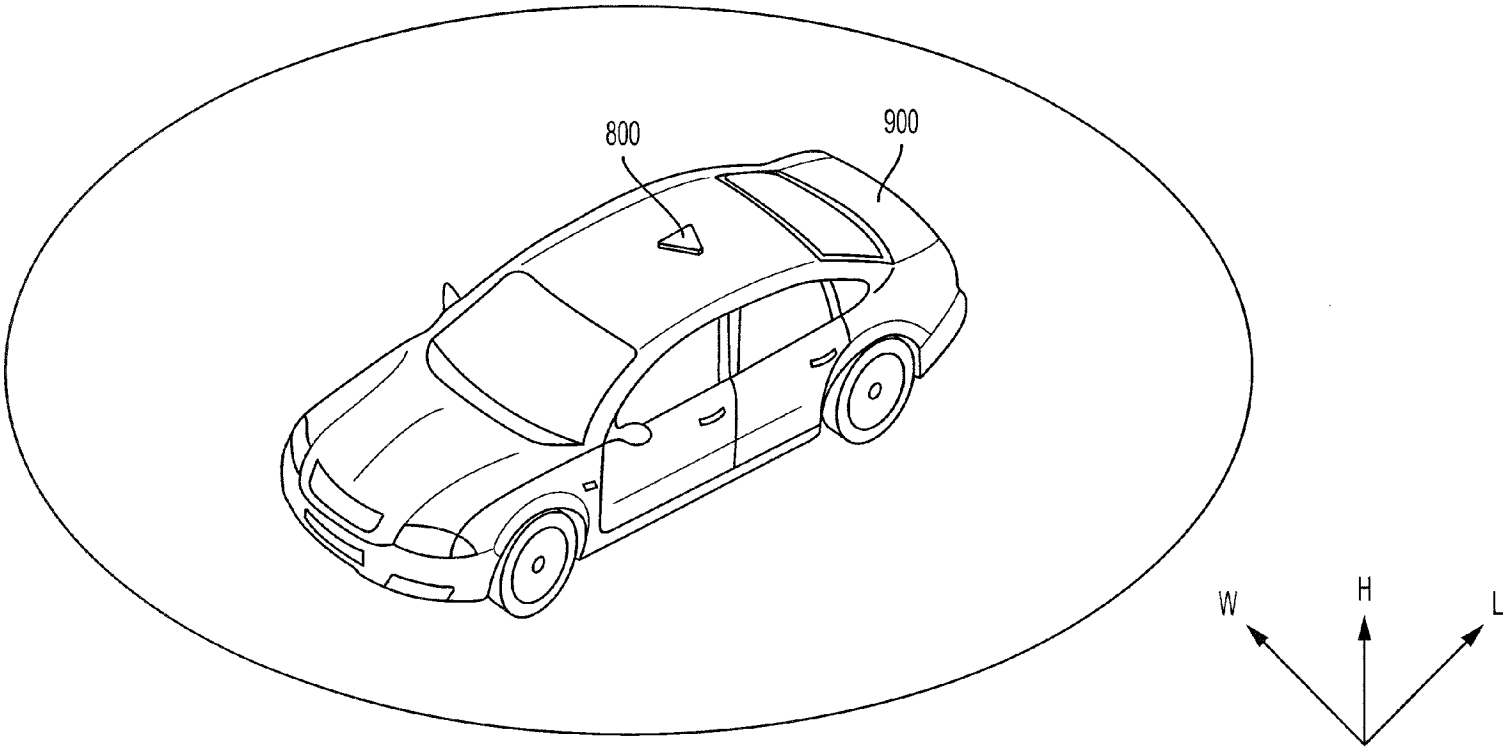
FIG. 9 is a drawing of a vehicle including the vehicular radar system of FIG. 8 according to an embodiment of the present invention.

Referring now to FIGS. 8 and 9, a vehicle 900 may include the vehicular radar system 800. The vehicular radar system 800 may be positioned on the vehicle such that it has a relatively unobstructed view in all directions around the vehicle 900. Because the vehicular radar system 800 can detect data in all directions around the vehicle 900, only one vehicular radar system 800 is needed. By providing all radar sensors and cameras in a single unit, the total cost of the vehicle 900 is reduced relative to vehicles that include multiple radar and/or sensor units. Furthermore, this reduces an amount of space on the vehicle 900 that is required for housing sensors.

Figure 10:
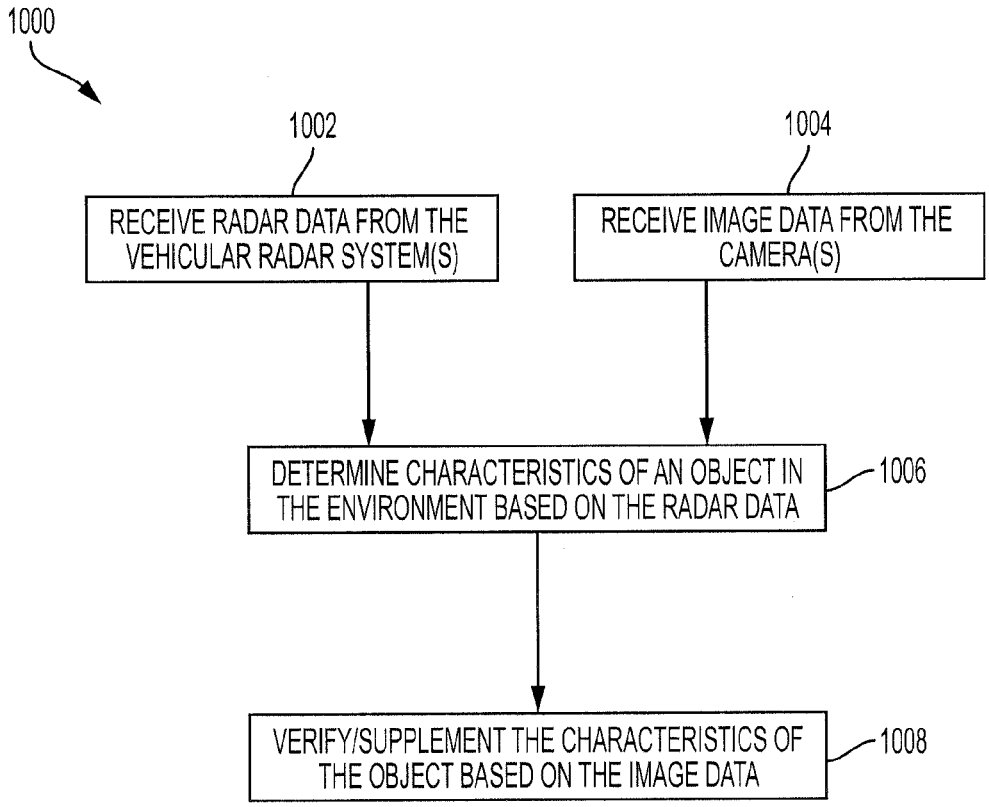
FIG. 10 is a flowchart illustrating a method for verifying or supplementing data detected using a radar system with data detected using the one or more cameras according to an embodiment of the present invention.

Turning to FIG. 10, a method 1000 is shown for verifying and/or supplementing data detected by a radar system using image data. The method 1000 may be performed by an ECU (e.g., ECU 114) of a vehicle that includes a vehicular radar system having multiple radar subsystems and at least one camera. In block 1002, the ECU may receive radar data detected by one or more radar subsystem of a vehicular radar system. The vehicular radar system may include radar subsystems oriented in one direction, two directions, or three directions.

In block 1004, the ECU may receive image data detected by cameras of the vehicular radar system. The image data may correspond to at least a portion of the area scanned by the radar subsystems. In that regard, an object in the environment of the vehicle may be detected by at least one radar subsystem and at least one camera.

In block 1006, the ECU may analyze the radar data detected by one or more of the radar subsystems. Based on the analysis, the ECU may determine that an object is present in the environment and may determine one or more characteristics of the object. For example, the ECU may determine a distance to the object, a size of the object, a direction of the object relative to the vehicle, an identity of the object, or the like.

In block 1008, the ECU may analyze the image data detected by one or more camera of the vehicular radar system. Based on the analysis, the ECU may determine that an object is present in the environment and may determine one or more characteristics regarding the object. The ECU may compare the presence of the object and the characteristics that were determined based on the image data to the presence of the object and the characteristics that were determined based on the radar data. If the presence of the object and the characteristics match, the ECU may confirm that the object is present and has the detected characteristics.

If the presence of the objects and the characteristics do not match, the ECU may proceed based on the assumption that the object is present and that the most hazardous characteristics that it determined are present for safety reasons. For example, if the image data indicates that an object is present but the radar data does not indicate that the object is present, the ECU may determine that the object is present for safety reasons. As another example, if the radar data indicates that the object is 10 feet tall by 3 feet wide and the image data indicates that the object is 3 feet tall by 1 foot wide then the ECU may determine that the object is 10 feet tall by 3 feet wide for safety reasons.

In some embodiments, the ECU may provide more weight to one of the radar data or the image data and determine which data is more likely to be accurate based on the provided weight. For example, the ECU may determine that the radar data is more likely to be accurate in clear weather conditions and the image data is more likely to be accurate in foggy or rainy conditions. In these embodiments, the ECU may assume that the radar data is correct in clear weather conditions and may assume that the image data is correct and foggy or rainy conditions. As another example, the ECU may determine that the radar data is always more likely to be accurate than the image data.

In some situations, the ECU may determine that an object is present based on the image data and the radar data but may determine one or more characteristics based on only one of the image data or the radar data. In some embodiments, the ECU may supplement the characteristics of the object by including the characteristics or characteristics that were determined based on only one of the image data or the radar data. For example, the ECU may determine that the object is present based on the image data and the radar data and may determine that the object is 5 feet away based solely on image data. The ECU may supplement the presence of the object by assuming that the object is 5 feet away based on the detected image data.

Exemplary embodiments of the methods/systems have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A vehicular radar system for performing a volumetric scan of an environment of a vehicle comprising:

a plurality of end-fire antennas including:

a first array of end-fire antennas positioned along a first plane and having a transmission end oriented in a first direction, a second array of end-fire antennas positioned along the first plane and having a transmission end oriented in a second direction that is different than the first direction, a third array of end-fire antennas positioned along a second plane above or below the first plane and having a transmission end oriented in the first direction, and a fourth array of end-fire antennas positioned along the second plane and having a transmission end oriented in the second direction; and at least one radio frequency integrated circuit (RFIC) coupled to the plurality of end-fire antennas and configured to control the plurality of end-fire antennas to scan for objects in the first direction, the second direction, and between the first direction and the second direction by transmitting signals of varying phases to the plurality of end-fire antennas.

2. The vehicular radar system of claim 1 further comprising a first printed circuit board (PCB) and a second PCB and wherein the first array of end-fire antennas and the second array of end-fire antennas are positioned on the first PCB and the third array of end-fire antennas and the fourth array of end-fire antennas are positioned on the second PCB.

3. The vehicular radar system of claim 1 wherein the first array of end-fire antennas and the third array of end-fire antennas are configured to detect three-dimensional data in the first direction and the second array of end-fire antennas and the fourth array of end-fire antennas are configured to detect three-dimensional data in the second direction.

4. The vehicular radar system of claim 1 wherein:

the plurality of end-fire antennas further includes:

a fifth array of end-fire antennas positioned along the first plane and having a transmission end oriented in a third direction that is different than the first direction and the second direction, and a sixth array of end-fire antennas positioned along the second plane and having a transmission end oriented in the third direction; and the at least one RFIC is further configured to control the plurality of end-fire antennas to scan for objects in third direction and between the second direction and the third direction.

5. The vehicular radar system of claim 1 further comprising:

electrical leads between the at least one RFIC and each of the plurality of end-fire antennas; and a radar mount having:

at least two walls each oriented perpendicular to the first plane and the second plane and having at least one flange configured to support the plurality of end-fire antennas, a cover configured to be positioned above the at least one RFIC and defining a plurality of openings each configured to receive one of the electrical leads to reduce transmission of undesirable signals away from the vehicular radar system, and a radome configured to at least partially enclose the plurality of end-fire antennas and to reduce reflection or loss of the signals transmitted by the plurality of end-fire antennas.

6. The vehicular radar system of claim 5 further comprising a radar processor coupled to the at least one RFIC and configured to receive signals from at least some of the plurality of end-fire antennas via the at least one RFIC and to process the signals, wherein:

the radar mount further includes a base defining a cavity;

the radar processor is positioned in the cavity of the base; and the radar mount further includes an edgeboard positioned on one of the at least two walls and configured to transmit signals between the at least one RFIC and the radar processor.

7. The vehicular radar system of claim 1 further comprising a camera configured to detect image data corresponding to the environment in at least one of the first direction, the second direction, or between the first direction and the second direction.

8. The vehicular radar system of claim 7 further comprising an electronic control unit (ECU) coupled to the camera and the at least one RFIC and wherein:

at least some of the plurality of end-fire antennas are configured to transmit a signal and at least some of the plurality of end-fire antennas are configured to receive a reflection of the signal; and the ECU is configured to determine characteristics of an object based on the reflection of the signal and to at least one of verify or supplement the characteristics of the object based on the detected image data.

9. A vehicle capable of three-dimensional scanning of an environment of the vehicle comprising:

a plurality of end-fire antennas including:

a first array of end-fire antennas positioned along a first plane and having a transmission end oriented in a first direction, a second array of end-fire antennas positioned along the first plane and having a transmission end oriented in a second direction that is different than the first direction, a third array of end-fire antennas positioned along a second plane above or below the first plane and having a transmission end oriented in the first direction, and a fourth array of end-fire antennas positioned along the second plane and having a transmission end oriented in the second direction;

at least one radio frequency integrated circuit (RFIC) coupled to the plurality of end-fire antennas and configured to receive signals from the plurality of end-fire antennas and to control the plurality of end-fire antennas to scan for objects in the first direction, the second direction, and between the first direction and the second direction by transmitting signals of varying phases to the plurality of end-fire antennas; and an electronic control unit (ECU) coupled to the at least one RFIC and configured to determine characteristics of an object in the environment based on the signals received by the at least one RFIC.

10. The vehicle of claim 9 further comprising a first printed circuit board (PCB) and a second PCB and wherein the first array of end-fire antennas and the second array of end-fire antennas are positioned on the first PCB and the third array of end-fire antennas and the fourth array of end-fire antennas are positioned on the second PCB.

11. The vehicle of claim 9 wherein the first array of end-fire antennas and the third array of end-fire antennas are configured to detect three-dimensional data in the first direction and the second array of end-fire antennas and the fourth array of end-fire antennas are configured to detect three-dimensional data in the second direction.

12. The vehicle of claim 9 wherein:

the plurality of end-fire antennas further includes:

a fifth array of end-fire antennas positioned along the first plane and having a transmission end oriented in a third direction that is different than the first direction and the second direction, and a sixth array of end-fire antennas positioned along the second plane and having a transmission end oriented in the third direction; and the at least one RFIC is further configured to control the plurality of end-fire antennas to scan for objects in third direction and between the second direction and the third direction.

13. The vehicle of claim 9 further comprising:

electrical leads between the at least one RFIC and each of the plurality of end-fire antennas; and a radar mount having:

at least two walls each oriented perpendicular to the first plane and the second plane and having at least one flange configured to support the plurality of end-fire antennas, a cover configured to be positioned above the at least one RFIC and defining a plurality of openings each configured to receive one of the electrical leads to reduce transmission of undesirable signals away from the vehicular radar system, and a radome configured to at least partially enclose the plurality of end-fire antennas and to reduce reflection or loss of signals transmitted by the plurality of end-fire antennas.

14. The vehicle of claim 13 further comprising a radar processor coupled to the at least one RFIC and configured to receive signals from at least some of the plurality of end-fire antennas via the at least one RFIC and to process the signals, wherein:

the radar mount further includes a base defining a cavity;

the radar processor is positioned in the cavity of the base; and the radar mount further includes an edgeboard positioned on one of the at least two walls and configured to transmit signals between the at least one RFIC and the radar processor.

15. The vehicle of claim 9 further comprising a camera configured to detect image data corresponding to the environment in at least one of the first direction, the second direction, or between the first direction and the second direction.

16. The vehicle of claim 15 wherein:

at least some of the plurality of end-fire antennas are configured to transmit a signal and at least some of the plurality of end-fire antennas are configured to receive a reflection of the signal; and the ECU is configured to determine the characteristics of the object based on the reflection of the signal and to at least one of verify or supplement the characteristics of the object based on the detected image data.

17. A vehicular radar system for performing a volumetric scan of an environment of a vehicle comprising:

a plurality of end-fire antennas including:

a first array of end-fire antennas positioned along a first plane and having a transmission end oriented in a first direction, a second array of end-fire antennas positioned along the first plane and having a transmission end oriented in a second direction that is different than the first direction, a third array of end-fire antennas positioned along a second plane above or below the first plane and having a transmission end oriented in the first direction, and a fourth array of end-fire antennas positioned along the second plane and having a transmission end oriented in the second direction;

a first radio frequency integrated circuit (RFIC) coupled to the first array of end-fire antennas and configured to control the first array of end-fire antennas to scan for objects in the first direction and towards the second direction from the first direction;

a second RFIC coupled to the second array of end-fire antennas and configured to control the second array of end-fire antennas to scan for objects in the second direction and towards the first direction from the second direction;

a third RFIC coupled to the third array of end-fire antennas and configured to control the third array of end-fire antennas to scan for objects in the first direction and towards the second direction from the first direction; and a fourth RFIC coupled to the fourth array of end-fire antennas and configured to control the fourth array of end-fire antennas to scan for objects in the second direction and towards the first direction from the second direction.

18. The vehicular radar system of claim 17 further comprising a first printed circuit board (PCB) and a second PCB and wherein the first array of end-fire antennas, the first RFIC, the second array of end-fire antennas, and the second RFIC are positioned on the first PCB, and wherein the third array of end-fire antennas, the third RFIC, the fourth array of end-fire antennas, and the fourth RFIC are positioned on the second PCB.

19. The vehicular radar system of claim 17 further comprising an electronic control unit (ECU) coupled to the first RFIC, the second RFIC, the third RFIC, and the fourth RFIC, wherein:

at least some of the plurality of end-fire antennas are configured to receive signals reflected from an object and to transmit the signals to a respective RFIC; and the ECU is configured to receive the signals from the respective RFIC and to determine characteristics of the object in three dimensions based on the received signals.

20. The vehicular radar system of claim 19 further comprising a camera coupled to the ECU and configured to detect image data corresponding to the environment and at least one of the first direction, the second direction, or between the first direction and the second direction, wherein the ECU is further configured to at least one of verify or supplement the characteristics of the object based on the detected image data.

* * * * *